US011313378B2

(12) United States Patent
Chen

(10) Patent No.: US 11,313,378 B2
(45) Date of Patent: Apr. 26, 2022

(54) ELECTRIC ROBOT FOR POOL CLEANING

(71) Applicant: NingBo Poolstar Pool Products Co., Ltd., Zhejiang (CN)

(72) Inventor: Liang Chen, Zhejiang (CN)

(73) Assignee: NingBo Poolstar Pool Products Co., Ltd., Ningbo (CN)

( * ) Notice: Subject to any disclaimer, the term of this patent is extended or adjusted under 35 U.S.C. 154(b) by 183 days.

(21) Appl. No.: 16/824,612

(22) Filed: Mar. 19, 2020

(65) Prior Publication Data

US 2021/0108650 A1 Apr. 15, 2021

(30) Foreign Application Priority Data

Oct. 11, 2019 (CN) ..... 201910965033.2

(51) Int. Cl.

| | |
|---|---|
| ***F04D 29/22*** | (2006.01) |
| ***E04H 4/16*** | (2006.01) |
| ***F04D 1/00*** | (2006.01) |
| ***F04D 13/08*** | (2006.01) |

(52) U.S. Cl.

CPC ..... *F04D 29/2261* (2013.01); *E04H 4/1654* (2013.01); *F04D 1/00* (2013.01); *F04D 13/086* (2013.01)

(58) Field of Classification Search

CPC ... B63H 1/02; B63H 1/04; B63H 1/06; B63H 11/04; B63H 11/101; E04H 4/1618; E04H 4/1636; E04H 4/1654; B08B 9/08; A47L 11/00; A47L 11/40; F04D 13/086; F04D 29/422; F04D 29/44; F04D 29/45; F04D 29/46; F04D 29/466; F04D 29/486; F04D 29/506; F04D 29/566; F04D 29/4293; F04D 29/2261; F04D 29/447

See application file for complete search history.

(56) References Cited

U.S. PATENT DOCUMENTS

| | | | | |
|---|---|---|---|---|
| 4,863,344 | A * | 9/1989 | Stefanini | F04D 29/2283 415/141 |
| 6,412,133 | B1 * | 7/2002 | Erlich | E04H 4/1663 15/1.7 |
| 7,108,293 | B2 | 9/2006 | Van Der Meijden et al. | |
| 8,784,652 | B2 | 7/2014 | Rief et al. | |
| 9,032,575 | B2 | 5/2015 | Sebor | |
| 10,370,865 | B2 * | 8/2019 | Roumagnac | B63H 11/04 |

* cited by examiner

*Primary Examiner* — Kenneth J Hansen

(57) ABSTRACT

The invention relates to electric robots, and more particularly to a electric robot for pool cleaning, including a base with a water inlet channel, a volute assembly and a motor assembly capable of outputting positive and negative torques; where the volute assembly is rotatably provided above the base and communicates with the water inlet channel; the volute assembly includes a casing and an impeller assembly provided therein; a water outlet is provided on a side of the casing, and an water outlet channel is provided inside the casing to allow water to flow through the impeller assembly; the motor assembly is provided on the base, and connected with the impeller assembly through an output shaft; and an upper end surface of the base is provided with a limit structure for limiting a rotation angle of the volute assembly.

10 Claims, 8 Drawing Sheets

ELECTRIC ROBOT FOR POOL CLEANING

CROSS-REFERENCE TO RELATED APPLICATIONS

This application claims the benefit of priority from Chinese Patent Application No. 201910965033.2, filed on Oct. 11, 2019. The content of the aforementioned application, including any intervening amendments thereto, is incorporated herein by reference in its entirety.

TECHNICAL FIELD

The present application relates to electric robots, more particularly to an electric robot for pool cleaning.

BACKGROUND OF THE INVENTION

The existing electric pool cleaning robots are generally provided with multiple motors to drive the caterpillar track to control steering motions, or provided with an electric pump impeller to drive rotation devices in cooperation with limit devices to discharge water multi-directionally, which in turn pushes the robots. However, the above two types of electric robots have the disadvantages of complex structures and components, as well as high production cost.

SUMMARY OF THE INVENTION

An object of the present invention is to provide an electric robot for pool cleaning to solve the drawback of the pool cleaning robot with the complex steering structure in the prior art.

To achieve the above object, the present application provides an electric robot for pool cleaning, comprising: a base with a water inlet channel, a volute assembly and a motor assembly capable of outputting positive and negative torques; wherein the volute assembly is rotatably provided above the base and communicates with the water inlet channel; the volute assembly comprises a casing and an impeller assembly provided therein; a water outlet is provided on a side of the casing, and a water outlet channel is provided inside the casing to allow water to flow through the impeller assembly;

the motor assembly is provided on the base, and connected to the impeller assembly through an output shaft; the base is provided with a limit structure for limiting a rotation angle of the volute assembly; and the impeller assembly is provided with a plurality of rotatable blades.

Further, the impeller assembly comprises an upper cover plate, a lower cover plate and a plurality of rotatable blades arranged therebetween.

Further, each of the rotatable blades has a hinged end and a swing end; the hinged end is hinged to the upper cover plate and/or the lower cover plate; and the impeller assembly further comprises a plurality of ribs provided on the upper cover plate and/or the lower cover for limiting a position of the swing end of the rotatable blade.

Further, adjacent two ribs limit a swing angle of the corresponding blade to 45°-180°.

Further, the limit structure comprises at least a forward-rotation limit block for limiting the water outlet from facing backward and a reverse-rotation limit block for limiting the water outlet from facing forward.

Further, the casing comprises an upper casing and a lower casing; wherein the lower casing is rotatably provided on the base and is provided with a water inlet in communication with the water inlet channel; the upper casing is provided with the water outlet; and a baffle plate is provided at the water outlet for enhancing water flow impact.

In an embodiment, the volute assembly is detachably provided on the base.

In an embodiment, the electric robot further comprises a seat; where the base is provided on the seat and forms a sealed inner cavity.

In an embodiment, the seat is provided with an external water inlet connected to the water inlet channel.

In an embodiment, the seat is provided with a drive wheel and a sensing element for detecting running conditions of the drive wheel, and the sensing element communicates with a control circuit.

Compared with the prior art, the electric robot for pool cleaning in the present invention has a simple steering drive structure, fewer parts and lower production cost.

DETAILED DESCRIPTION OF EMBODIMENTS

Figure 1:
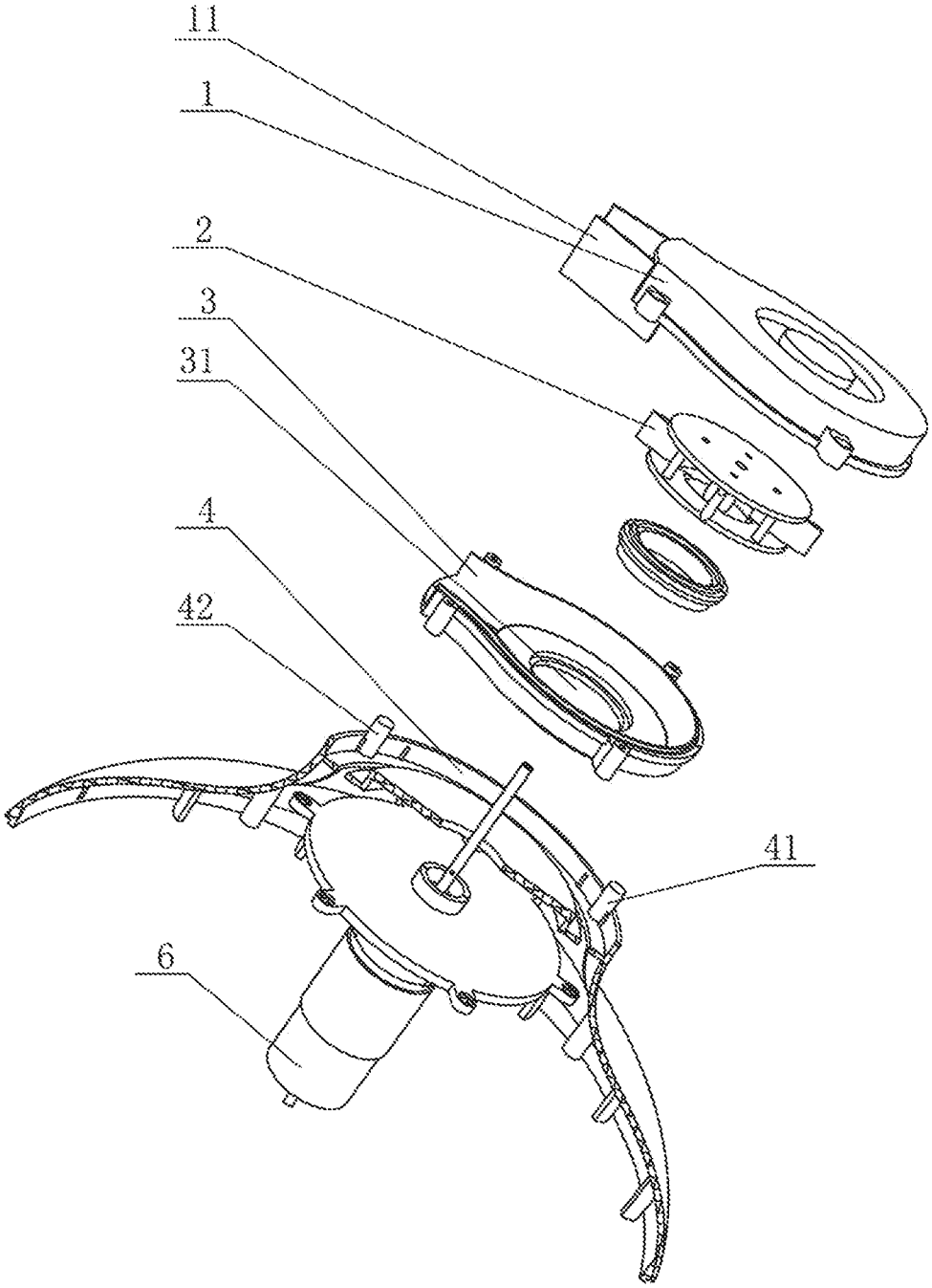
FIG. 1 is an exploded view of an electric robot for pool cleaning according to a first embodiment of the present invention.

In order to make objects, technical solutions and advantages of the invention clearer, the invention will be further described below in detail with reference to the accompanying drawings and embodiments. It should be understood that the embodiments described herein are only illustrative of the present invention, and are not intended to limit the scope of the present invention.

Now, the invention will be described below in detail with reference to the accompanying drawings.

Embodiment 1

An electric robot for pool cleaning provided herein is shown in FIGS. 1-11, which includes a base 4, a volute assembly and a motor assembly 6 capable of outputting positive and negative torques; where a water inlet channel 8 is provided in the base 4, and the motor assembly 6 is provided below the base 4.

The volute assembly is rotatably provided above the base 4 and communicates with the water inlet channel 8. Specifically, the volute assembly includes a casing and an impeller assembly 2 provided therein. A water outlet 7 is provided on a side of the casing, and a water outlet channel is provided inside the casing to allow water to flow through the impeller assembly 2. An output shaft of the motor assembly 6 is connected with the impeller assembly 2.

An upper end surface of the base 4 is provided with a limit structure for limiting a rotation angle of the volute assembly.

After the motor assembly 6 outputs the torques, the impeller assembly 2 and the volute assembly are driven to rotate. The volute assembly stops rotating when it rotates to the limit structure, thereby determining the direction of the water outlet 7. Water flow is accelerated by the impeller assembly 2 to flow out of the water outlet 7 to drive the electric robot to move in a direction opposite to the direction of the water outlet 7.

Directions in which the impeller assembly 2 and the volute assembly rotate can be changed by switching the direction of the torques output by the motor assembly 6. The volute assembly cannot continue to rotate when it rotates in another direction to another limit structure, so that another direction of the water outlet 7 is determined, thereby changing the movement direction of the electric robot for pool cleaning.

It can be seen from the above process that the electric robot for pool cleaning in this embodiment has a simple steering drive structure, fewer parts and low production cost.

Preferably, as shown in FIGS. 5-8, the impeller assembly 2 includes an upper cover plate 21, a lower cover plate 23 and a plurality of blades 22 arranged therebetween.

Each blade 22 has a hinged end 221 and a swing end, where the hinged end 221 is hinged to the upper cover plate 21 and/or the lower cover plate 23. The impeller assembly 2 further includes a plurality of ribs provided on the upper cover plate 21 and/or the lower cover plate 23 for limiting the position of the swing end of respective blades 22. After receiving an impact of the water flow, the blades 22 begin to swing with the hinged end 221 as a circle center. When the swing end abuts against a corresponding rib 24, the blades 22 cannot continue to swing, thereby forming a fixed angle.

Figure 6:
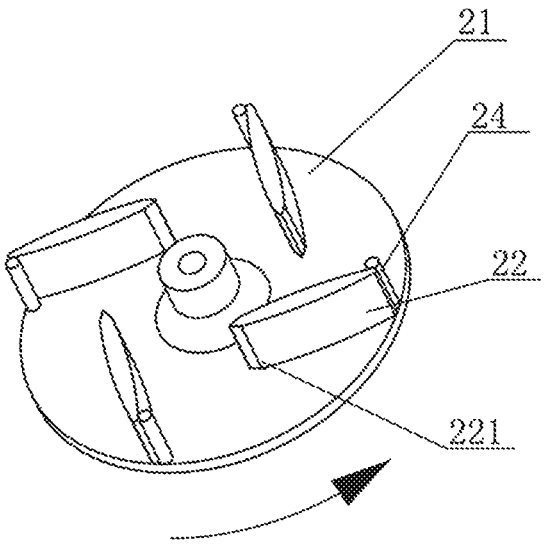
FIG. 6 schematically shows the blades swinging in a counterclockwise direction in the first embodiment of the present invention.
Figure 7:
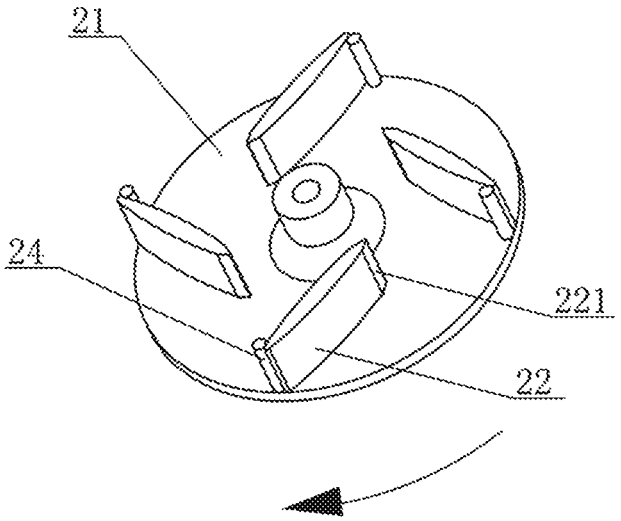
FIG. 7 schematically shows the blades swinging in a clockwise direction in the first embodiment of the present invention.
Figure 8:
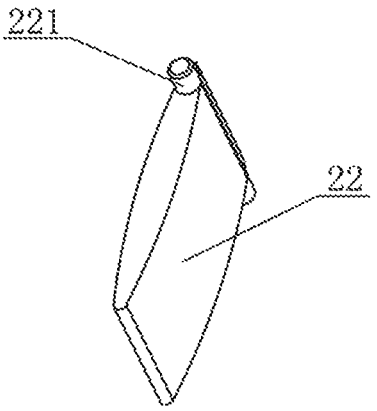
FIG. 8 is schematic diagram of the blade of the impeller assembly in the first embodiment of the present invention.
Figure 9:
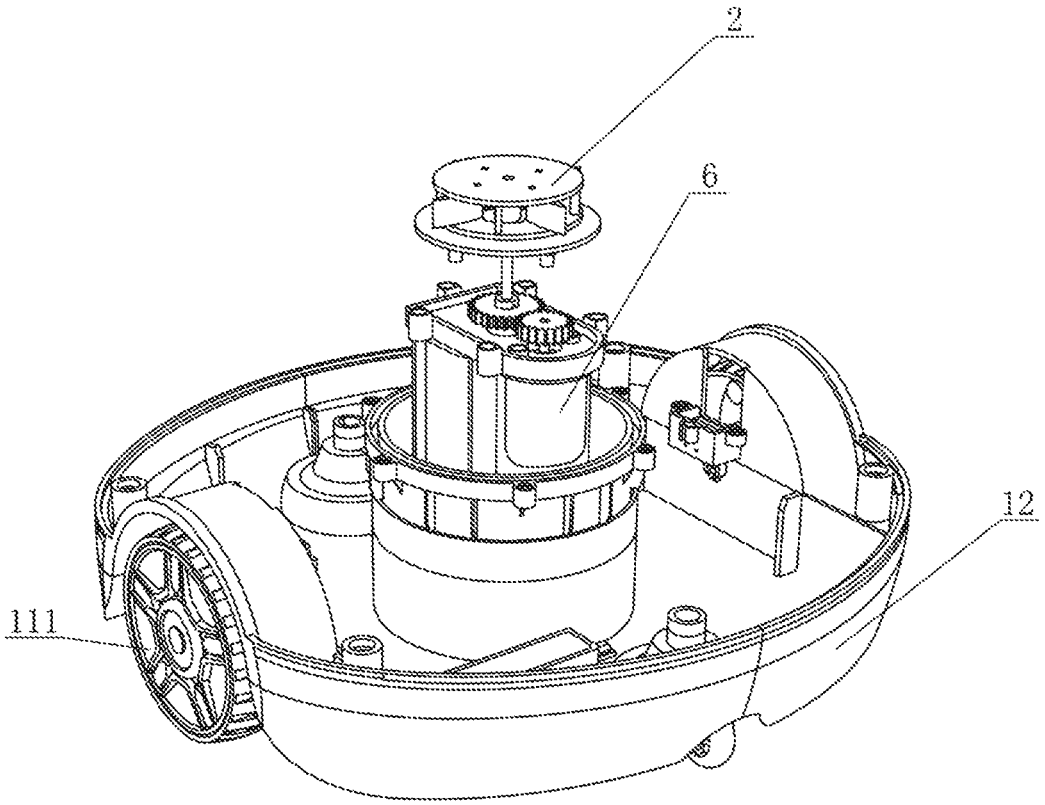
FIGS. 9-11 schematically show various parts of a seat in the first embodiment of the present invention.
Figure 10:
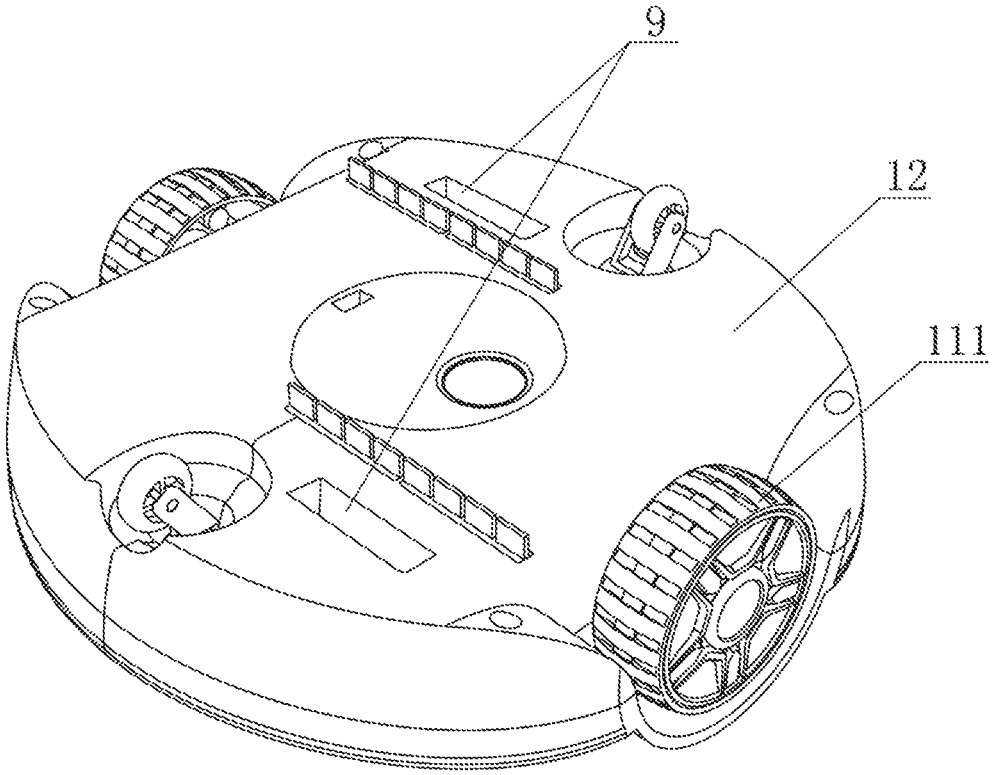
Figure 11:
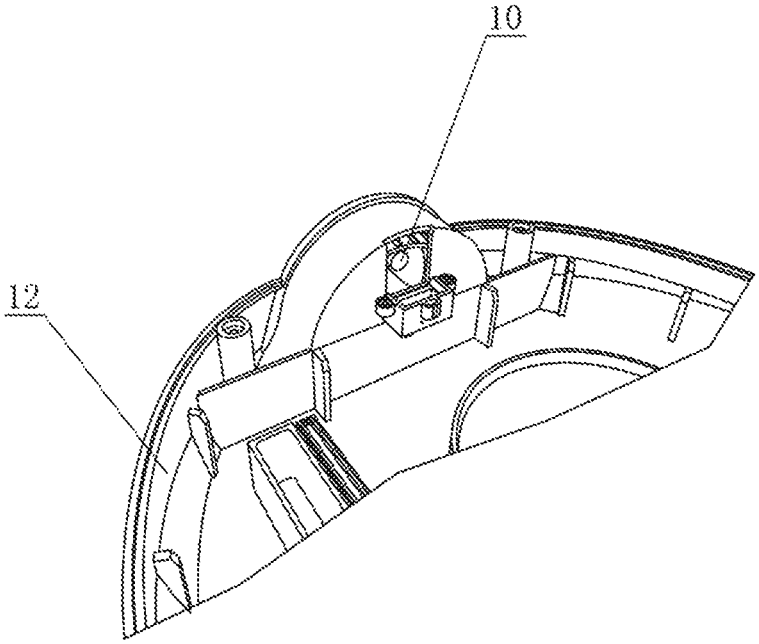

Specifically, as shown in FIG. 6, when the impeller assembly 2 rotates clockwise, respective blades 22 swing in a direction as indicated by an arrow until it abuts the corresponding rib 24 after receiving the resistance of the water flow, thereby forming high-efficiency backward-curved impellers as shown in the figure. Correspondingly, as shown in FIG. 7, when the impeller assembly 2 rotates counterclockwise, respective blades 22 swing in a direction as indicated by an arrow until it abuts the corresponding rib 24 after receiving the resistance of the water flow, thereby forming high-efficiency backward-curved impellers as shown in the figure. Therefore, the impeller assembly 2 in this embodiment can autonomously adjust angles of respective blades 22 according to the rotation direction to adapt to the water flow, thereby improving the work efficiency.

Specifically, a rotation angle of respective blades 22 is 360° in the absence of ribs 24. In this embodiment, the swinging angle of respective blades 22 is limited by two adjacent ribs 24 to 45°-180°.

Figure 2:
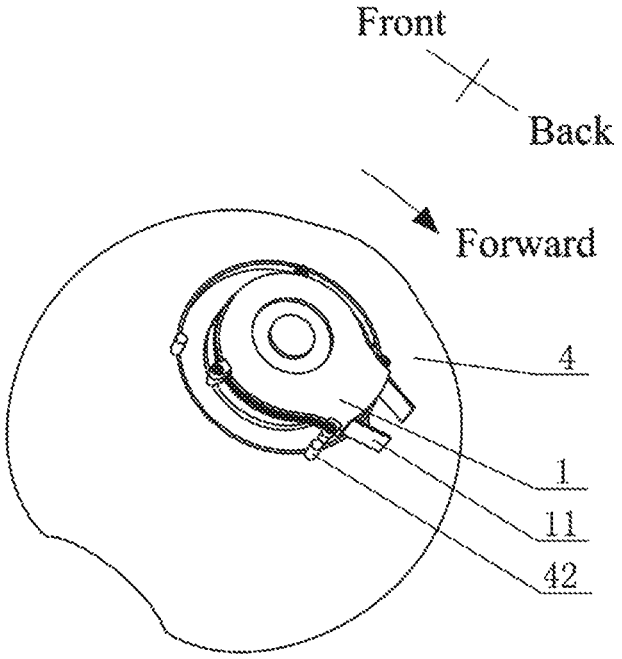
FIG. 2 schematically shows a water outlet of a volute assembly in a forward direction in the first embodiment of the present invention.
Figure 3:
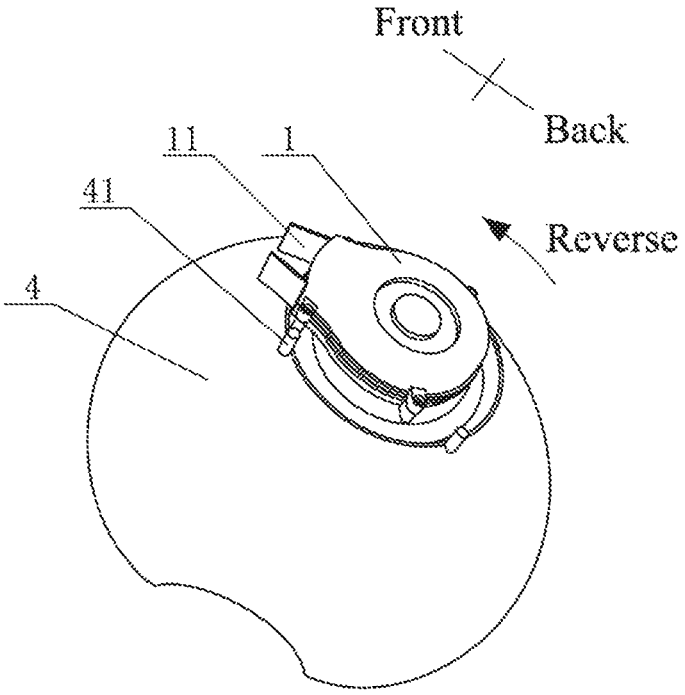
FIG. 3 schematically shows the water outlet of the volute assembly in a reverse direction in the first embodiment of the present invention.
Figure 4:
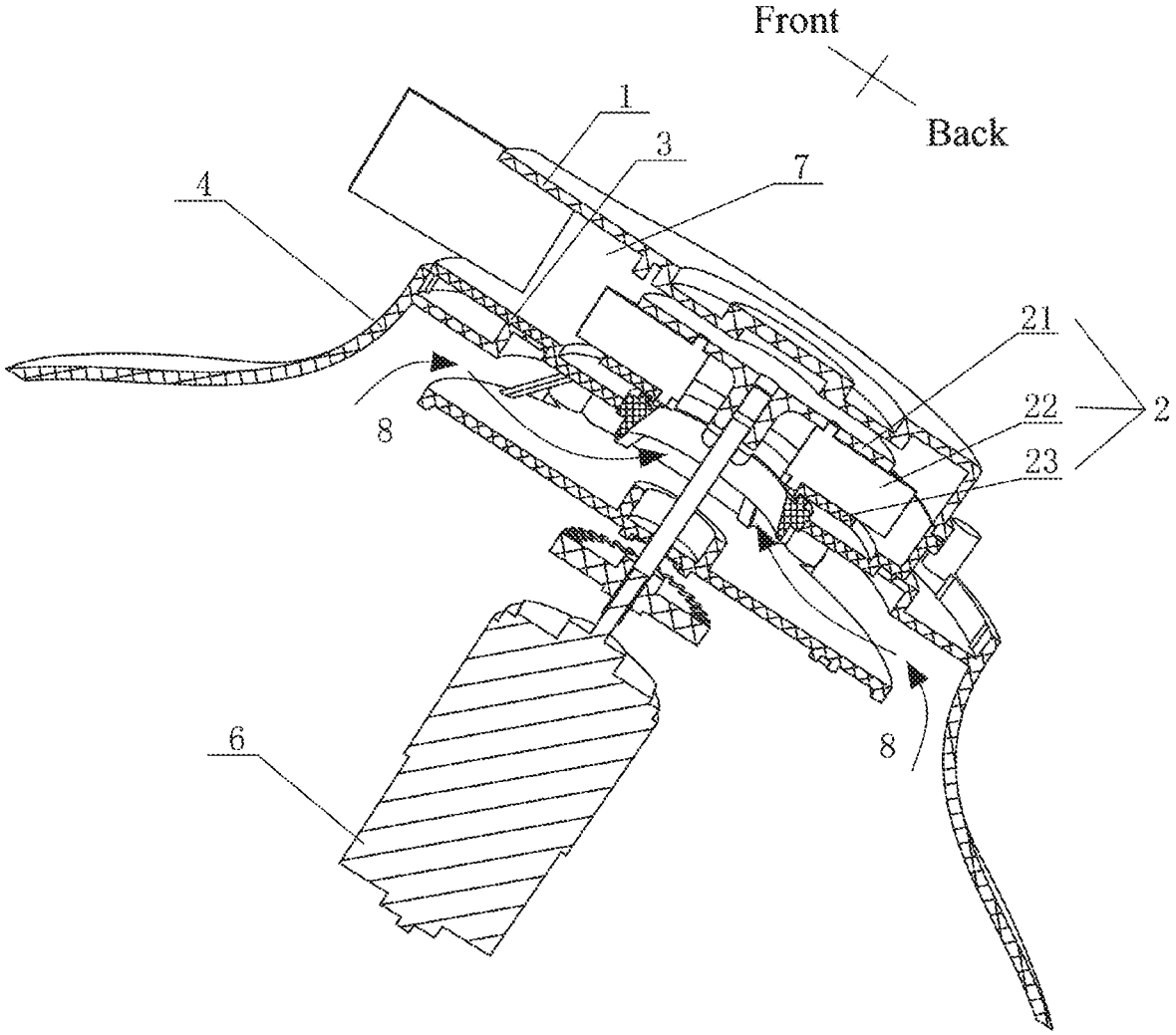
FIG. 4 is a sectional view of the electric robot for pool cleaning in the first embodiment of the present invention.
Figure 5:
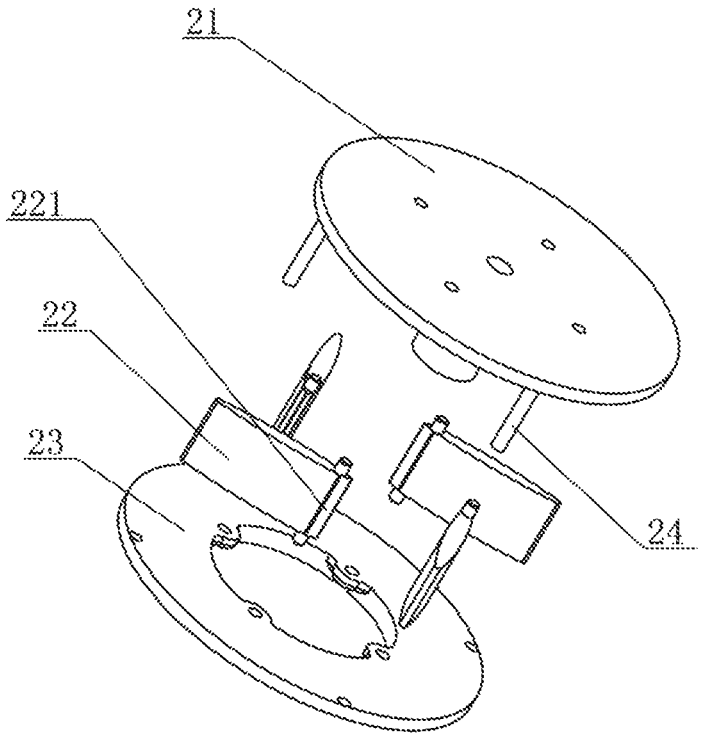
FIG. 5 is an exploded view of an impeller assembly in the first embodiment of the present invention.

As shown in FIGS. 1-3, preferably, the limit structure includes a forward-rotation limit block 42 and a reverse-rotation limit block 41, where the forward-rotation limit block 42 is configured to restrict the water outlet 7 from facing backward and the reverse-rotation limit block 41 is configured to restrict the water outlet 7 from facing forward, thereby completing forward and backward movements of the electric robot for pool cleaning through the cooperation of the two.

As shown in FIGS. 1 and 2, the casing specifically includes an upper casing 1 and a lower casing 3, where the lower casing 3 is rotatably provided on the base 4 and is provided with a water inlet 31 for communicating with the water inlet channel 8; and the upper casing 1 is provided with the water outlet 7, and a baffle plate 11 is provided at the water outlet 7 for enhancing an impact of the water flow.

The volute assembly is detachably provided on the base 4 for easy replacement.

As shown in FIGS. 1 and 9-11, the base 4 is provided on the seat 12, and forms a sealed inner cavity which accommodates the motor assembly 6 and a control circuit and to prevent water from entering. The seat 12 is provided with an external water inlet 9, which is connected with the water inlet channel 8 to allow water to be fed from outside.

The seat 12 is provided with a drive wheel 111 and a sensing element 10 for detecting a running condition of the drive wheel 111. The sensing element 10 communicates with the control circuit. The sensing element 10 can determine that the electric robot for pool cleaning is out of operation while detecting that the drive wheel 111 is stopped, and then feed back the information to the control circuit to change the rotation direction of the motor assembly 6, thereby changing the movement direction of the electric robot for pool cleaning.

Embodiment 2

Figure 12:
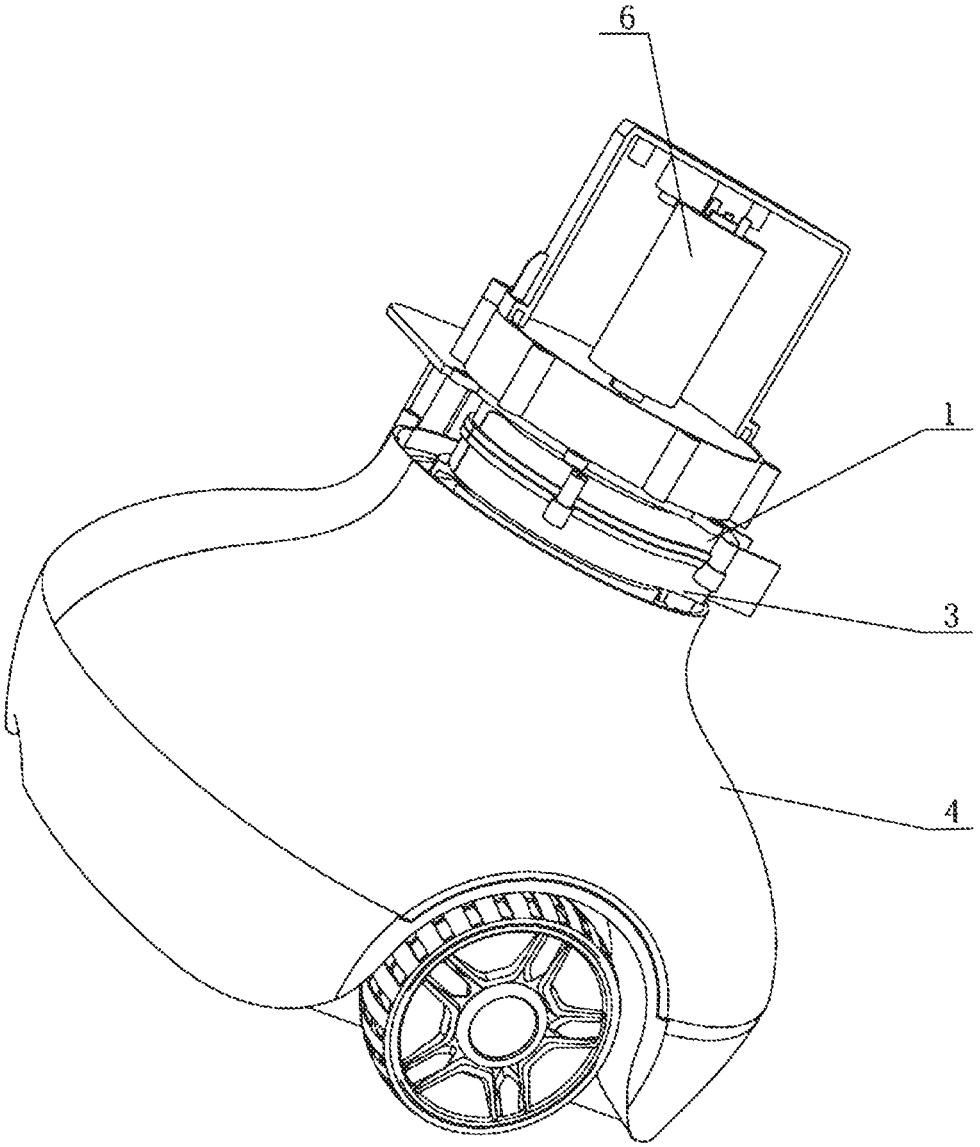
FIG. 12 schematically shows an arrangement of a motor assembly in a second embodiment of the present invention.

Provided herein is another embodiment of an electric robot for pool cleaning, as shown in FIG. 12. The electric robot includes a base 4, a volute assembly and a motor assembly 6 capable of outputting positive and negative torques. The volute assembly includes an upper casing 1 and a lower casing 3. The parts that are not mentioned here are similar to the first embodiment.

In contrast with Embodiment 1, the motor assembly 6 in this embodiment is provided above the base 4, and the volute assembly (the upper casing 1 and the lower casing 3) is provided under the base 4. A groove is provided on a side wall of the base 4 to expose the volute assembly, allowing for the swinging of the volute assembly. Two ends of the groove form a limit structure so as to limit the swing angle of the volute assembly when it rotates in the groove. This changes the water discharge direction through the rotation and then the travelling direction of the electric robot for pool cleaning. The specific implementation principle will be omitted.

The above-mentioned embodiments are only preferred embodiments of the present invention, and not intended to limit the scope of the invention. Any modifications, equivalent replacements and improvements made without departing from the spirit of the invention shall fall within the scope of the invention as defined by the appended claims.

What is claimed is:

1. An electric robot for pool cleaning, comprising:

a base with a water inlet channel, a volute assembly, and a motor assembly capable of outputting positive and negative torques;

wherein the volute assembly is rotatably provided above the base and communicates with the water inlet channel; the volute assembly comprises a casing and an impeller assembly provided therein; a water outlet is provided on a side of the casing, and a water outlet channel is provided inside the casing to allow water to flow through the impeller assembly;

the motor assembly is provided below the base, and connected to the impeller assembly via an output shaft;

the motor assembly is further configured to drive the volute assembly to rotate and to switch the rotation direction of the volute assembly by outputting positive and negative torques so as to change the water outlet direction and movement direction of the electric robot;

the base is provided with a limit structure comprising at least two limit blocks that are configured to limit a rotation angle of the volute assembly; and the impeller assembly is provided with a plurality of rotatable blades.

2. The electric robot of claim 1, wherein the impeller assembly comprises an upper cover plate, a lower cover plate and the plurality of rotatable blades arranged therebetween.

3. The electric robot of claim 2, wherein each of the rotatable blades has a hinged end and a swing end; the hinged end is hinged to the upper cover plate and/or the lower cover plate; and the impeller assembly further comprises a plurality of ribs provided on the upper cover plate and/or the lower cover for limiting a position of the swing end of each of the rotatable blades.

4. The electric robot of claim 3, wherein an adjacent two ribs of the plurality of ribs limit a swing angle of one corresponding blade to of the plurality of blades to 45°-180.

5. The electric robot of any one of claim 1, wherein the limit structure comprises at least a forward-rotation limit block for limiting the water outlet from facing backward and a reverse-rotation limit block for limiting the water outlet from facing forward.

6. The electric robot of any one of claim 1, wherein the casing comprises an upper casing and a lower casing; the lower casing is rotatably provided on the base and is provided with a water inlet in communication with the water inlet channel; the upper casing is provided with the water outlet; and a baffle plate is provided at the water outlet for enhancing water flow impact.

7. The electric robot of any one of claim 1, wherein the volute assembly is detachably provided on the base.

8. The electric robot of any one of claim 1, further comprising a seat; wherein the base is provided on the seat and forms a sealed inner cavity.

9. The electric robot of claim 8, wherein the seat is provided with an external water inlet connected to the water inlet channel.

10. The electric robot of claim 8, wherein the seat is provided with a drive wheel and a sensing element configured to detect whether the drive wheel is stopped or not, and if the drive wheel is stopped, feedback the information to a control circuit to change the movement direction of the electric robot.

* * * * *